US009734740B1

(12) United States Patent
Lopez et al.

(10) Patent No.: US 9,734,740 B1
(45) Date of Patent: Aug. 15, 2017

(54) REGULATION COMPLIANCE MATERIAL ORGANIZER AND METHOD OF USE

(71) Applicants: Lindsey Lopez, Brooklyn, NY (US); Lisa P. Siafos, East Elmhurst, NY (US)

(72) Inventors: Lindsey Lopez, Brooklyn, NY (US); Lisa P. Siafos, East Elmhurst, NY (US)

( * ) Notice: Subject to any disclaimer, the term of this patent is extended or adjusted under 35 U.S.C. 154(b) by 0 days.

(21) Appl. No.: 15/059,955

(22) Filed: Mar. 3, 2016

(51) Int. Cl.
*G09F 19/00* (2006.01)
*G09F 15/02* (2006.01)
*G09F 15/00* (2006.01)

(52) U.S. Cl.
CPC ..... *G09F 15/025* (2013.01); *G09F 15/005* (2013.01)

(58) Field of Classification Search
CPC ..... G09F 7/00; G09F 7/18; G09F 7/22; G09F 1/10; G09F 21/02
USPC ..... 40/492, 766; 402/17
See application file for complete search history.

(56) References Cited

U.S. PATENT DOCUMENTS 1,685,080 A * 9/1928 Auchincloss ..... B60R 13/105 40/588
1,687,859 A * 10/1928 Fontaine ..... B42F 15/06 206/806
1,709,041 A * 4/1929 Schutt ..... A63B 71/0672 2/279
1,711,070 A * 4/1929 Suydam, Jr. ..... A47B 97/02 211/46
1,880,165 A * 9/1932 Winzeler ..... B42D 5/042 40/119
2,065,624 A * 12/1936 Summers ..... A63B 71/0672 116/223
2,194,010 A * 3/1940 Cooke ..... G09F 7/00 40/119
2,945,594 A * 7/1960 Parker ..... B42F 13/02 211/46
3,170,260 A * 2/1965 Parker ..... A47F 7/143 40/124
3,518,782 A * 7/1970 Long ..... B60R 13/10 116/28 R
4,178,710 A * 12/1979 Schmid ..... G09F 7/22 40/530
4,357,772 A * 11/1982 Amick ..... G09F 7/18 248/159
4,632,241 A * 12/1986 Brough ..... A47F 7/163 190/1
4,666,409 A * 5/1987 Sandberg ..... G09B 1/12 248/441.1

(Continued)

*Primary Examiner* — Shin Kim
(74) *Attorney, Agent, or Firm* — Gulf Coast Intellectual Property Group

(57) ABSTRACT

A compliance material organizer and display device that is operable to receive and retain a plurality of compliance posters being different in size and provide display thereof. The compliance material organizer includes a wall mount that is configured to be secured to a wall. The wall mount has secured thereto a ring mount wherein the ring mount is configured to be expandable in length so as to be extended to a length of at least three feet. A plurality of rings are secured to the ring mount and are movable so as to receive and suspend therefrom numerous compliance posters. The compliance material organizer and display is configured to receive, retain and display a plurality of compliance posters wherein the posters are arranged in a stacked pattern against the wall with the largest compliance poster being proximate the wall.

7 Claims, 3 Drawing Sheets

(56) References Cited

U.S. PATENT DOCUMENTS 4,756,556 A * 7/1988 Ader ..... A61F 4/00 281/15.1
4,810,544 A * 3/1989 Hickman ..... B42D 1/10 229/67.1
4,886,390 A * 12/1989 Silence ..... B42F 13/16 402/29
4,982,683 A * 1/1991 Earnest, Jr. ..... G09F 21/02 116/63 P
5,291,677 A * 3/1994 Samson ..... A47G 1/14 40/494
5,903,991 A * 5/1999 Sasse ..... G09F 7/22 248/156
5,909,687 A * 6/1999 Tapper ..... B42F 5/00
6,012,594 A * 1/2000 Heinz ..... A47B 97/02 211/106
6,109,456 A * 8/2000 Heinz ..... A47B 97/02 211/106
6,138,391 A * 10/2000 Ngan ..... G09D 3/00 40/119
6,253,475 B1 * 7/2001 Ruebens ..... B42D 1/08 40/405
6,481,054 B1 * 11/2002 Hillstrom ..... A63B 71/0672 16/252
6,665,967 B1 * 12/2003 Quackenbush ..... G09F 21/04 40/588
6,666,609 B2 * 12/2003 Fanning ..... B42F 15/06 24/67 R
6,764,241 B1 * 7/2004 Tower ..... B42D 5/005 116/234
6,802,145 B2 * 10/2004 Sparkowski ..... G09F 7/18 40/606.18
6,820,853 B1 * 11/2004 DuBarry ..... A47G 1/1686 211/70.5
6,854,202 B1 * 2/2005 Ives ..... G09F 15/0087 40/491
6,854,915 B1 * 2/2005 Ong ..... B42F 13/0013 206/472
6,895,702 B1 * 5/2005 Colbert ..... G09D 3/00 283/2
7,043,859 B1 * 5/2006 Meyer ..... G09F 11/02 40/492
7,059,482 B2 * 6/2006 Reid ..... A47F 7/163 211/118
2002/0133988 A1 * 9/2002 Spelman ..... G09F 7/00 40/586
2003/0079389 A1 * 5/2003 Eberly ..... G09F 7/00 40/586
2005/0193610 A1 * 9/2005 Rost ..... G09F 7/12 40/654.01

* cited by examiner

REGULATION COMPLIANCE MATERIAL ORGANIZER AND METHOD OF USE

PRIORITY UNDER 35 U.S.C SECTION 119(e) & 37 C.F.R. SECTION 1.78

This nonprovisional application claims priority based upon the following prior United States Provisional Patent Application entitled: Organizer, Application No. 62/276,773 filed Jan. 8, 2016, in the name of Lindsey Lopez, which is hereby incorporated by reference for all purposes.

FIELD OF THE INVENTION

The present invention relates generally to organizational devices, more specifically but not by way of limitation, an organizer operable to provide organization of a plurality of regulation and/or compliance posters that are required to be made available to employees of a business.

BACKGROUND

Millions of businesses are subjected to various regulations from different regulatory agencies. By way of example but not limitation, a business must follow rules and regulations for wages, employment conditions and good manufacturing practices. As part of the requirements for the aforementioned categories and many others, employers must make available to employees various information regarding areas such as the Fair Labor Standards Act(FLSA), safety and health requirements which is regulated by OSHA, first aid information and material safety data sheets(MSDS). The aforementioned only represent a portion of the materials and/or information that an employer must make readily available to their employees.

One issue with making the aforementioned material available to employees is space. Many of the required documents and/or information must be displayed in poster format so as to be readily viewable by an employee. While some information such as MSDS's can be stored in handbooks and available upon request, certain information about the Fair Labor and Standards Act are required to be visibly present in areas such as but not limited to a break room. One problem with the aforementioned requirement of providing information in a break room is the physical space required to present the material. The regulatory posters required to be displayed can require a large area and many businesses simply do not have sufficient wall space to display. As a result, some of the material may not be displayed properly or be displayed in various locations throughout the workplace which can lead to compliance risks for the business owners.

Accordingly, there is a need for a compliance material organizer that is configured to facilitate the display of regulatory information in a single location wherein the compliance material organizer can receive and display compliance posters of various sizes and further facilitate the categorization thereof.

SUMMARY OF THE INVENTION

It is the object of the present invention to provide a regulatory compliance material organizer configured to display various compliance posters that is configured to provide presentation of the compliance posters in a single location.

Another object of the present invention is to provide a regulatory compliance material organizer operable to provide visibility and access to a plurality of compliance posters wherein the regulatory compliance material organizer is configured to be mounted to a vertical wall.

A further object of the present invention is to provide a regulatory compliance material organizer configured to display various compliance posters wherein the regulatory compliance material organizer includes a plurality of transparent sleeves operable to receive and retain compliance posters.

Still another object of the present invention is to provide a regulatory compliance material organizer operable to provide visibility and access to a plurality of compliance posters wherein the transparent sleeves are provided in various sizes.

An additional object of the present invention is to provide a regulatory compliance material organizer configured to display various compliance posters wherein the regulatory compliance material organizer includes a retractable wall mount that is variable in length.

Yet a further object of the present invention is to provide a regulatory compliance material organizer operable to provide visibility and access to a plurality of compliance posters that includes at least two rings that are configured to releasably secure a plurality of compliance posters.

Another object of the present invention is to provide a regulatory compliance material organizer configured to display various compliance posters wherein the regulatory compliance material organizer organizes and displays the compliance posters in a stacked configuration such that each poster is superposed a poster adjacent thereto.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
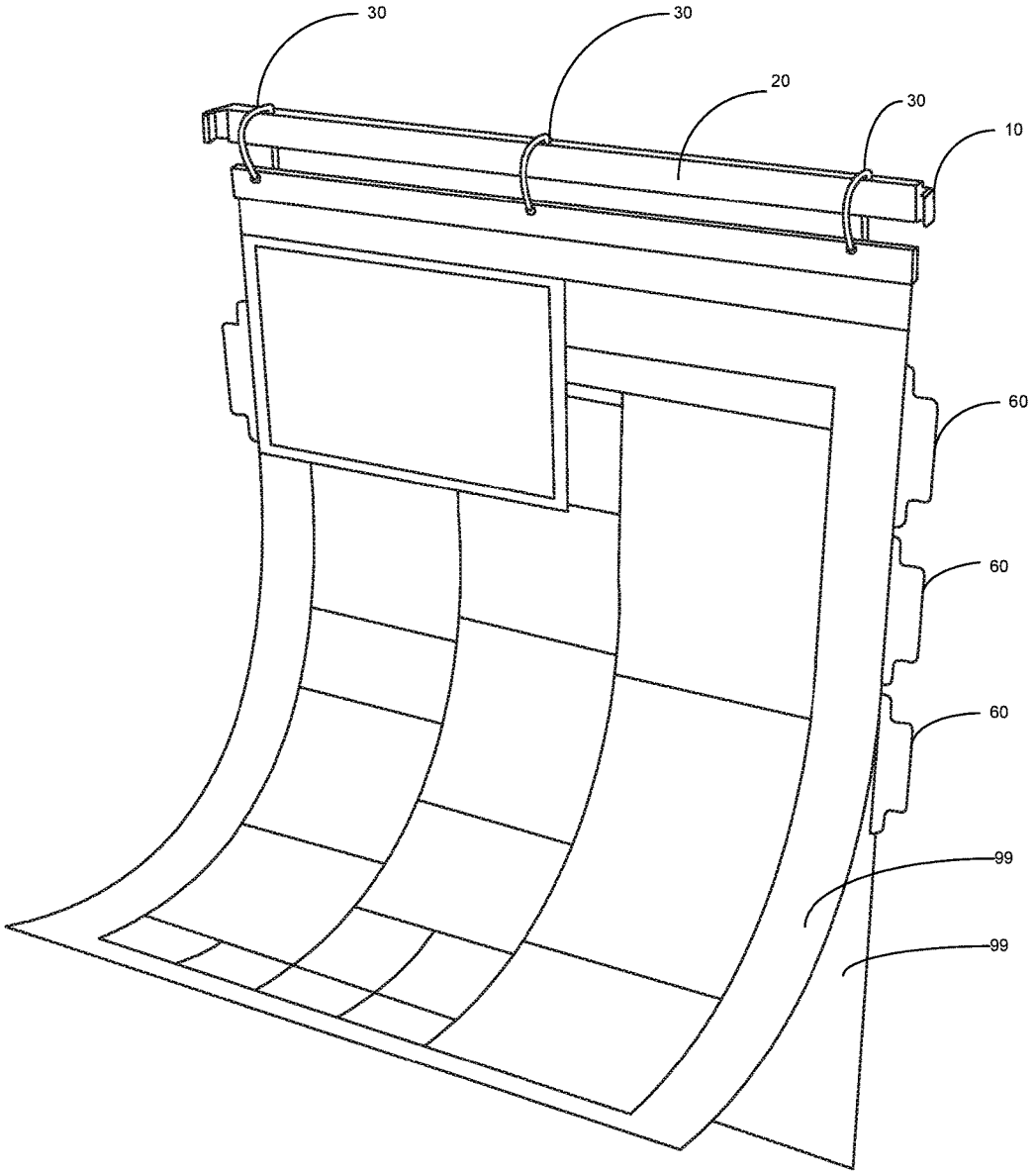
FIG. 1 is a perspective view of the present invention.

Referring now to the drawings submitted herewith, wherein various elements depicted therein are not necessarily drawn to scale and wherein through the views and figures like elements are referenced with identical reference numerals, there is illustrated a regulatory compliance material organizer 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1, the regulatory compliance material organizer 100 further includes a wall mount 10. The wall mount 10 is manufactured from a suitable durable material such as but not limited to metal. The wall mount 10 is elongated in manner and is generally rectangular in shape. The wall mount 10 functions to secure the regulatory compliance material organizer 100 to a conventional vertical wall utilizing fasteners such as but not limited to screws. While no particular size for the wall mount 10 is required, it is contemplated within the scope of the present invention to provide a wall mount 10 that is at least thirty-six inches in length. This length is desirable as it provides sufficient width to accommodate larger compliance posters.

Figure 2:
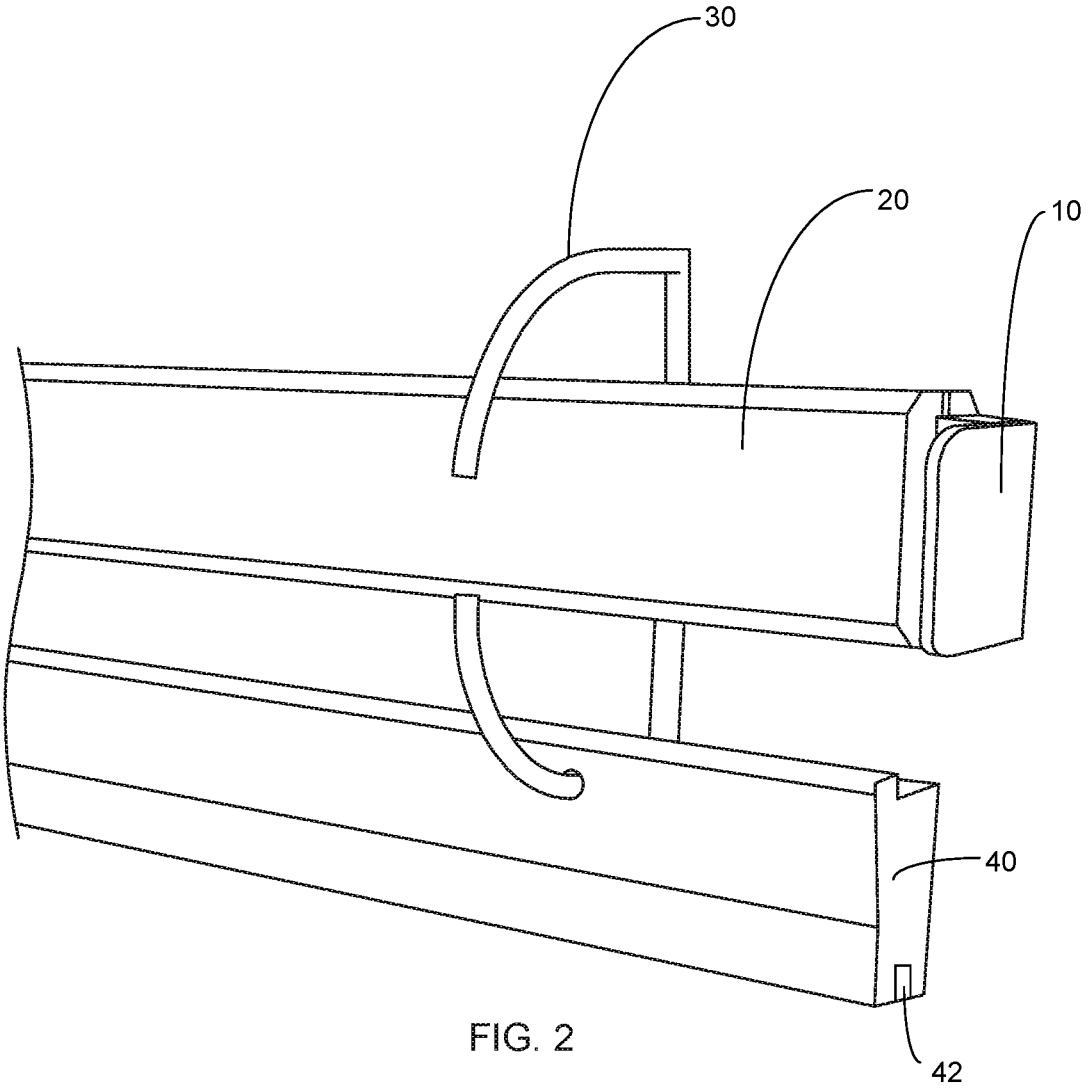
FIG. 2 is a detailed view of the mounting apparatus of the present invention.

Secured to the wall mount 10 utilizing suitable durable techniques is the retractable ring mount 20. The retractable ring mount 20 is designed to accommodate a plurality of rings 30 in order to secure a multitude of posters 99 in a stacked arrangement as illustrated herein in FIG. 1. The retractable ring mount 20 is slidably mounted to the wall mount 10 utilizing suitable durable techniques. The retractable ring mount 20 is configured to be altered in length so as to position rings 30 in the required location so as to secure exemplary posters 99 having different widths. It is contemplated within the scope of the present invention that the retractable ring mount 20 could be constructed utilizing numerous alternate techniques such as but not limited to telescoping segments in order to accomplish the desired functionality as described herein. The rings 30 are manufactured from a suitable durable material such as but not limited to metal. While the rings 30 are illustrated herein as being d-shaped, it is contemplated within the scope of the present invention that the rings 30 could be provided in various alternate shapes. Furthermore, while the rings 30 are shown with void 32 in FIG. 2 herein, which functions to allow a user to load an exemplary poster onto the ring 30, it is contemplated within the scope of the present invention that the rings 30 could be constructed in numerous other configurations so as to provide the ability to engage an exemplary poster 99.

While not particularly illustrated herein, it is contemplated within the scope of the present invention that the regulatory compliance material organizer 100 further include a hole punching element. The hole punching element could be secured or integrated into the wall mount 10 or sleeve holder 40 wherein the hole punching element is operable to punch holes into an exemplary poster 99 so as to subsequently be engaged with the rings 30. Those skilled in the art will recognize that the hole punching element could be comprised of a conventional hole punch and provided in various sizes and configuration in order to achieve the desired objective as stated herein.

The regulatory compliance material organizer 100 further includes sleeve holder 40. The sleeve holder 40 is generally rectangular in shape and manufactured from a suitable durable material such as but not limited to metal. The sleeve holder 40 provides an alternate method of displaying and hanging exemplary posters 99 wherein the exemplary posters 99 are placed in transparent sleeves (not illustrated herein) for organizing and display. Sleeve holder 40 includes keeper slot 42 that is configured to receive a plurality of transparent sleeves therein and further provide a bias thereagainst so as to secure the transparent sleeves. It is contemplated within the scope of the present invention that the sleeve holder 40 could be provided in alternate configurations and still achieve the objective as defined herein. It should be further recognized that the keeper slot 42 could be configured utilizing various different elements to provide a biased force against a portion of a transparent sleeve inserted thereinto.

As shown in particular in FIG. 1 herein, the regulatory compliance material organizer 100 includes a plurality of tabs 60. The tabs 60 are configured to be secured to either the exemplary poster 99 or a transparent sleeve in which the exemplary poster 99 will be placed thereinto. The tabs 60 extend outward from the exemplary posters 99 and function to provide a technique for a user to identify and engage a particular exemplary poster 99. While not particularly illustrated herein, it is contemplated within the scope of the present invention that the tabs 60 could have indicia imprinted thereon that provides identification of the material on the exemplary poster 99. Those skilled in the art will recognize that the tabs 60 could be provided in alternate sizes and different colors.

Figure 3:
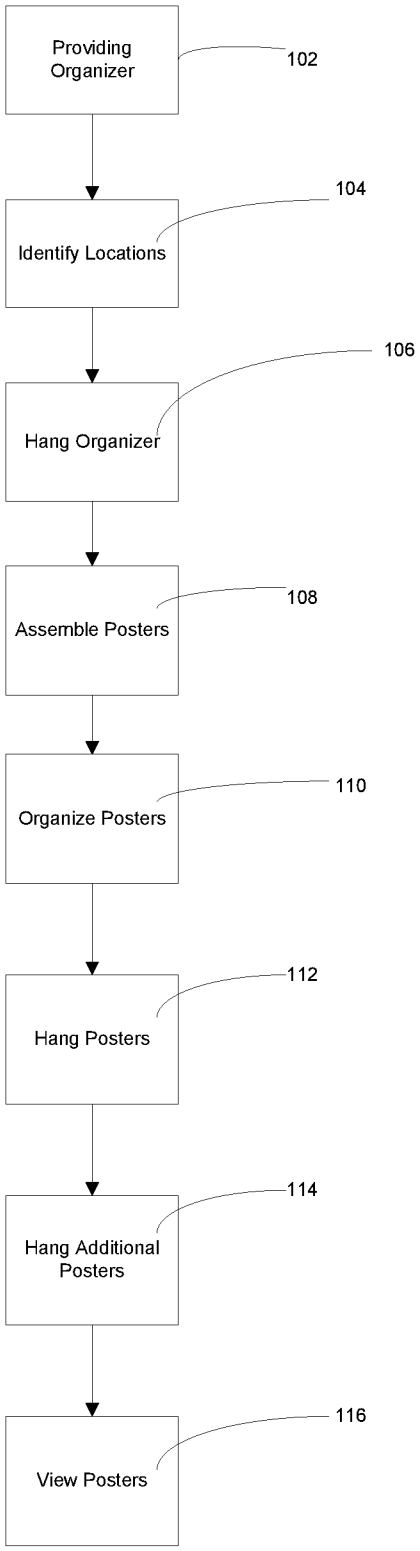
FIG. 3 is a method of use of the present invention.

Referring in particular to FIG. 3, the method of the present invention is illustrated therein. In use, the method for the regulatory compliance material organizer 100 includes step 102 wherein the step includes providing a regulatory compliance material organizer 100 to a user. In step 104, the user will identify a compliant location to hang the regulatory compliance material organizer 100. Step 106 comprises the hanging of the regulatory compliance material organizer 100 utilizing suitable durable fasteners. In step 108, a user will assemble the compliance posters that are required to be displayed. Step 110 includes organizing the posters in the order in which they will be hung on the regulatory compliance material organizer 100. The organization of the posters will include an arrangement such that the largest of the posters will be adjacent the wall to which the regulatory compliance material organizer 100 has been attached and the smallest of the posters will be distal to the wall to which the regulatory compliance material organizer 100 has been secured. In step 112, a user will hang the poster utilizing the rings 30 wherein the first poster hung will be the largest poster so that the largest poster is most proximate the wall to which the regulatory compliance material organizer 100 is attached. Step 114 includes the hanging of additional posters as required wherein the hanging of additional posters is executed in such a manner that the larger of the posters is suspended first and the smallest of the posters is suspended last. In step 116, a user will view and review the posters being displayed in a stacked pattern by the regulatory compliance material organizer 100 wherein a user can sort through the stacked pattern of posters utilizing tabs 60.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A method of displaying a plurality of compliance posters wherein at least two of the compliance posters are different in size comprising the steps of:

providing a compliance material organizer, said compliance material organizer including a wall mount, said wall mount being rectangular in shape, said wall mount having a first end and a second end, said compliance material organizer having a ring mount, said ring mount further having coupled thereto a plurality of rings;

identifying a location, said identifying a location where the compliance material organizer is to be placed within a facility;

hanging the compliance material organizer, said compliance material organizer being secured to a vertical wall utilizing suitable fasteners;

assembling a plurality of compliance posters;

organizing the plurality of compliance posters, wherein the compliance posters are organized in an order to be engaged with the compliance material organizer, the compliance poster being organized such that the largest compliance poster will be engaged with the compliance material organizer such that the largest compliance poster will be adjacent the wall to which the compliance material organizer is secured;

hanging a first compliance poster, wherein hanging the first compliance poster includes engaging the largest compliance poster with the plurality of rings and hanging from the compliance material organizer wherein the largest compliance poster is adjacent the wall;

hanging additional compliance posters, wherein the hanging additional compliance posters includes placing a compliance poster that is smallest in size farthest from the wall to which the compliance material organizer is secured;

viewing the compliance posters, wherein a user will view a desired compliance poster.

2. The method of displaying a plurality of compliance posters as recited in claim 1, wherein the compliance material organizer further including a sleeve holder, said sleeve holder having a bottom and a top, said top of said sleeve holder being releasably secured to said plurality of rings, said sleeve holder being mounted beneath said wall mount, said sleeve holder being configured to receive an retain a plurality of transparent sleeves.

3. The method of displaying a plurality of compliance posters as recited in claim 2, and further including the step of providing tabs, said tabs being configured to be secured to said plurality of compliance posters, said tabs operable to assist in the identification of the material contained on the plurality of compliance posters.

4. The method of displaying a plurality of compliance posters as recited in claim 3, wherein the ring mount of the compliance material organizer is expandable in length so as to accommodate compliance posters having different sizes.

5. The method of displaying a plurality of compliance posters as recited in claim 4, wherein the ring mount is configured to be expandable to at least three feet in length.

6. The method of displaying a plurality of compliance posters as recited in claim 5, wherein said sleeve holder further includes a keeper slot, said keeper slot configured to receive and retain a plurality of transparent sleeves.

7. The method of displaying a plurality of compliance posters as recited in claim 6, and further including the step of punching holes in the compliance posters, wherein the punching holes in the compliance posters configuring the compliance posters to be secured to said plurality of rings.

* * * * *